US008613141B2

(12) United States Patent
Okano et al.

(10) Patent No.: US 8,613,141 B2
(45) Date of Patent: Dec. 24, 2013

(54) MANUFACTURING METHOD OF LIQUID EJECTION HEAD

(75) Inventors: Akihiko Okano, Kawasaki (JP); Maki Kato, Kawasaki (JP); Masaki Ohsumi, Yokosuka (JP); Yoshinori Tagawa, Yokohama (JP); Kazuhiro Asai, Kawasaki (JP); Masahiko Kubota, Tokyo (JP); Tamaki Sato, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 929 days.

(21) Appl. No.: 12/268,760

(22) Filed: Nov. 11, 2008

(65) Prior Publication Data

US 2009/0133256 A1 May 28, 2009

(30) Foreign Application Priority Data

Nov. 13, 2007 (JP) ..... 2007-294267

(51) Int. Cl.
*B41J 2/16* (2006.01)
*B21D 53/76* (2006.01)

(52) U.S. Cl.
USPC ..... 29/890.1; 29/611; 430/270.1; 216/27; 216/44; 347/47; 347/61

(58) Field of Classification Search
USPC ..... 29/890.1, 611; 430/270.1, 320; 216/27, 216/44, 47; 347/56, 61, 47; 428/201
See application file for complete search history.

(56) References Cited

U.S. PATENT DOCUMENTS 4,657,631 A 4/1987 Noguchi
4,775,445 A 10/1988 Noguchi
5,047,281 A * 9/1991 Betz et al. ..... 428/201
5,213,946 A * 5/1993 Shirai et al. ..... 430/270.1
5,478,606 A 12/1995 Ohkuma et al.
6,137,510 A 10/2000 Sato et al.
6,142,607 A * 11/2000 Takata et al. ..... 347/47
6,315,853 B1 11/2001 Kubota et al.
6,455,112 B1 9/2002 Ohkuma et al.
6,464,345 B2 10/2002 Kubota et al.
6,472,125 B1 10/2002 Koide et al.
6,497,475 B1 12/2002 Kubota et al.
6,533,400 B1 3/2003 Kudo et al.
6,663,229 B2 12/2003 Komuro et al.

(Continued)

FOREIGN PATENT DOCUMENTS

JP 01294048 A * 11/1989 ..... 29/890.1 X
JP 3-10089 2/1991
JP 3143308 12/2000

*Primary Examiner* — A. Dexter Tugbang

(74) *Attorney, Agent, or Firm* — Fitzpatrick, Cella, Harper & Scinto

(57) ABSTRACT

A manufacturing method of a liquid ejection head provided with a flow passage communicating with an ejection outlet for ejecting liquid includes steps of preparing a substrate on which a flow passage wall forming member for forming a part of a wall of the flow passage and a solid layer having a shape of a part of the flow passage contact each other, wherein the flow passage wall forming member has a height, from a surface of the substrate, substantially equal to that of the solid layer; providing on the solid layer a pattern having a shape of another part of the flow passage; providing a coating layer, for forming another part of the wall of the flow passage, so as to coat the pattern; providing the ejection outlet to the coating layer; and forming the flow passage by removing the solid layer and the pattern.

17 Claims, 5 Drawing Sheets

(56) References Cited

U.S. PATENT DOCUMENTS

| | | | | |
|---|---|---|---|---|
| 6,910,760 | B2 | 6/2005 | Kubota et al. | |
| 6,960,424 | B2 | 11/2005 | Miyagawa et al. | |
| 7,005,244 | B2 * | 2/2006 | Park et al. | 430/320 |
| 7,036,909 | B2 | 5/2006 | Kubota et al. | |
| 7,070,912 | B2 | 7/2006 | Park et al. | |
| 7,282,243 | B2 | 10/2007 | Ohkuma et al. | |
| 7,287,847 | B2 | 10/2007 | Fujii et al. | |
| 7,300,596 | B2 | 11/2007 | Murayama et al. | |
| 7,389,585 | B2 | 6/2008 | Sato et al. | |
| 2003/0011655 | A1 | 1/2003 | Miyagawa et al. | |
| 2006/0114295 | A1 | 6/2006 | Asai et al. | |
| 2007/0017894 | A1 * | 1/2007 | Murayama et al. | 216/27 |
| 2007/0099121 | A1 | 5/2007 | Kubota et al. | |
| 2007/0176990 | A1 | 8/2007 | Urayama et al. | |
| 2007/0178248 | A1 | 8/2007 | Ohsumi et al. | |
| 2007/0207414 | A1 | 9/2007 | Murayama et al. | |
| 2008/0227035 | A1 | 9/2008 | Kanri et al. | |
| 2009/0136875 | A1 | 5/2009 | Kubota et al. | |
| 2009/0162797 | A1 | 6/2009 | Tsuji et al. | |
| 2009/0167812 | A1 | 7/2009 | Asai et al. | |
| 2009/0229125 | A1 | 9/2009 | Kato et al. | |

* cited by examiner

MANUFACTURING METHOD OF LIQUID EJECTION HEAD

FIELD OF THE INVENTION AND RELATED ART

The present invention relates to a manufacturing method of a liquid ejection head. Specifically, the present invention relates to a manufacturing method of an ink jet recording head used in an ink jet recording method or the like.

An ink jet head applied to an ink jet recording method (liquid ejection recording method) for carrying out recording by ejecting recording liquid such as ink is generally provided with ink flow passages, energy generating elements, and minute ink ejection outlets (called "orifice"). Ink present in the ink flow passage is ejected from the ink ejection outlet in the form of ink droplets by energy from the energy generating element provided at a part of the ink flow passage.

As a method of preparing such an ink jet head, e.g., the following methods have been conventionally proposed.

(1) First, in an element substrate on which heaters for generating thermal energy for liquid ejection, a drive circuit for driving these heaters, and the like are formed, a through hole for supplying ink is formed. Thereafter, a pattern to be formed as a wall of an ink flow passage is formed of a negative photosensitive resin material and to the pattern, a plate in which ink ejection outlets are formed by electroforming or excimer laser machining is bonded, thus manufacturing the ink jet head.

(2) First, an element substrate formed similarly as in the above method (1) is prepared. Further, in a resin film (usually preferably formed of polyimide) on which an adhesive layer is applied, ink flow passages and ink ejection outlets are formed by excimer laser. Then, the thus processed ink flow passage structure plate and the element substrate are bonded to each other under heat and pressure.

In the ink jet heads manufactured by the above-described manufacturing method, in order to enable ejection of minute ink droplets for high-quality recording, a distance between a heater and an ejection outlet affecting an ejection amount is required to be decreased as short as possible. For this purpose, it is also necessary to lower a height of the ink flow passages and decrease a size of an ejection chamber which is a part of the ink flow passage and contacts a liquid ejection energy generating portion and a size of the ejection outlets. That is, in order to enable ejection of minute ink droplets by the ink jet heads manufactured by the above-described manufacturing methods, the ink flow passage structure plate to be laminated on the substrate is required to be formed in a thin film. However, there is difficulty in bonding the thin-film ink flow passage structure plate to the substrate with high accuracy.

In order to solve these problems, U.S. Pat. No. 4,775,445 discloses a manufacturing method of an ink jet head as described below. First, a mold of an ink flow passage is formed of a photosensitive material on a substrate on which a liquid ejection energy generating element is formed by patterning. Then, onto the substrate, a coating resin layer is applied so as to coat the mold pattern and the coating resin layer, an ink ejection outlet communicating with the mold of the ink flow passage is formed. Thereafter, the photosensitive material used for forming the mold is removed.

Further, U.S. Pat. No. 7,070,912 discloses a method in which a side wall of a flow passage is formed on a substrate and thereafter a sacrificial layer is formed at a portion for forming a flow passage and is abraded to be flattened together with the side wall and thereafter a photosensitive resin material is applied and an ejection outlet is formed in the photosensitive resin material.

In recent years, with respect to the ink jet recording head, further high speed and further high quality are required, so that formation of minute ejection outlets at a high density with accuracy is required, while a lowering in resistance of ink which passes through the flow passages to reach the ejection outlets is required.

SUMMARY OF THE INVENTION

The present invention has accomplished in view of the above-described problems.

A principal object of the present invention is to provide a liquid ejection head capable of not only forming minute ejection outlets and flow passages at a high density with accuracy but also optimizing a resistance of ink in the flow passages.

According to an aspect of the present invention, there is provided a manufacturing method of a liquid ejection head provided with a flow passage communicating with an ejection outlet for ejecting liquid, the manufacturing method comprising:

preparing a substrate on which a flow passage wall forming member for forming a part of a wall of the flow passage and a solid layer having a shape of a part of the flow passage contact each other, wherein the flow passage wall forming member has a height, from a surface of the substrate, substantially equal to that of the solid layer;

providing on the solid layer a pattern having a shape of another part of the flow passage;

providing a coating layer, for forming another part of the wall of the flow passage, so as to coat the pattern;

providing the ejection outlet to the coating layer; and forming the flow passage by removing the solid layer and the pattern.

According to the present invention, it is possible to provide a liquid ejection head in which the minute ejection outlets and flow passages have been formed at a high density with accuracy and a resistance of ink in the flow passages has been optimized.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
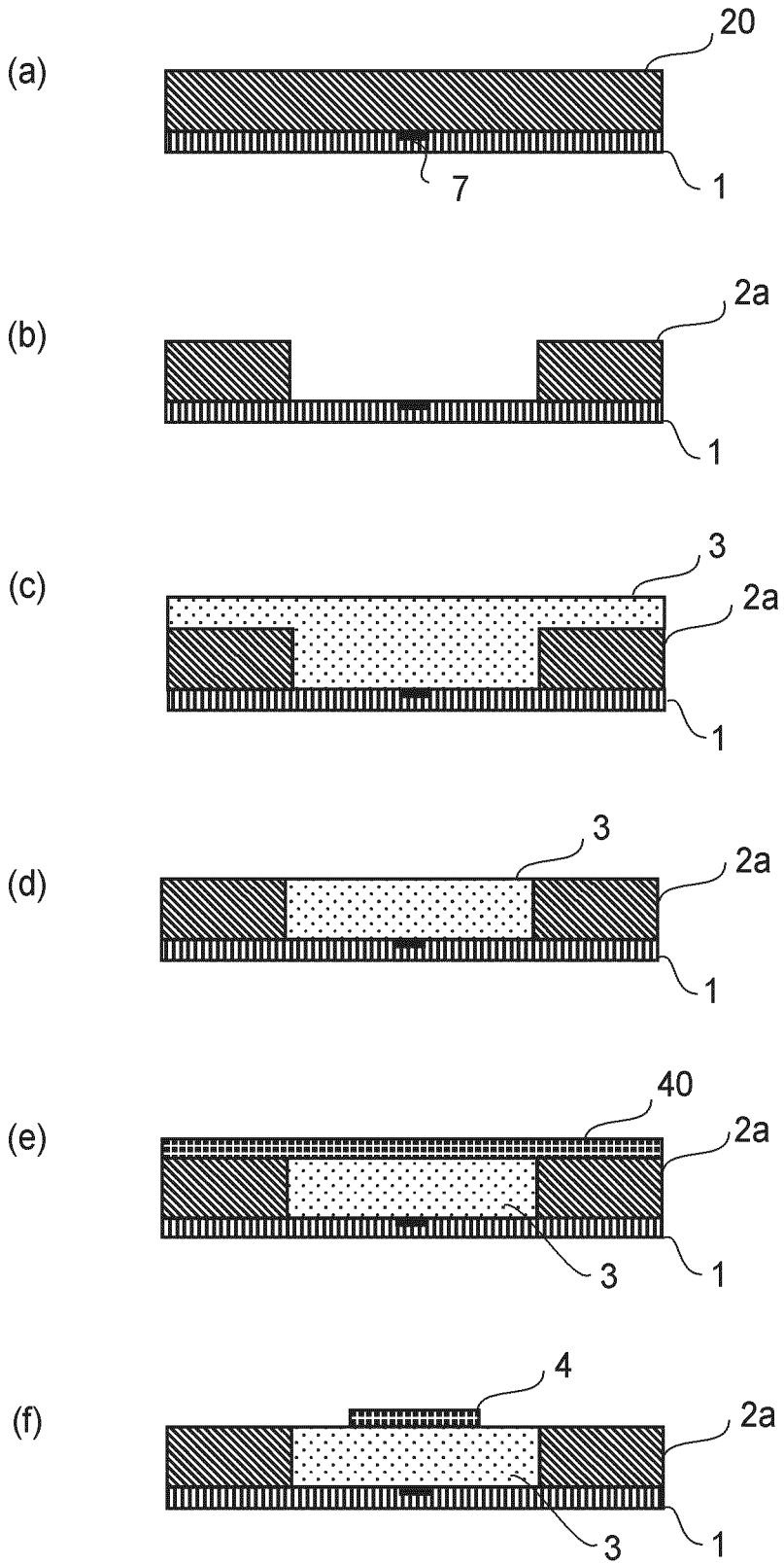
FIGS. 1(*a*) to 1(*f*) are schematic sectional views for illustrating an embodiment of the manufacturing method of a liquid ejection head according to the present invention.

Hereinbelow, embodiments of the manufacturing method of a liquid ejection head according to the present invention will be described.

In the following description, an ink jet recording head (hereinafter referred to as a "recording head") as an example of the liquid ejection head will be described illustratively. As other applications, the liquid ejection head can be applied to industrial applications, medical applications, and the like.

Further, in the figures, constituent members having the same function are represented by the same reference numerals or symbols and are omitted from redundant explanation in some cases.

The recording head (the ink jet recording head) is mountable to a printer, a copying machine, a facsimile machine including a communication system, a device such as a word processor including a printer portion, and industrial recording devices compositively combined with various processing devices. Further, by using this recording head, it is possible to carry out recording on various recording media (materials) such as paper, thread, fiber, fabric, leather, metal, plastic, glass, wood, and ceramics. Herein, "recording" means not only that a significant image such as a character image or a graphical image is provided to the recording medium but also that an insignificant image such as a pattern image is provided to the recording medium.

Figure 4:
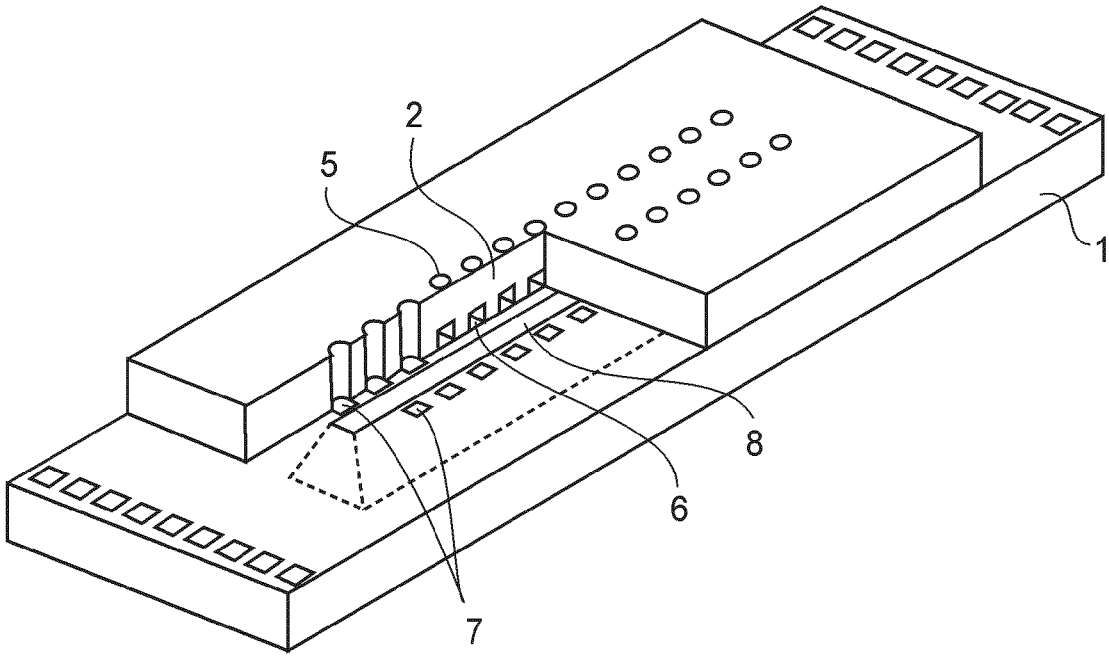
FIG. 4 is a schematic perspective view for illustrating the embodiment of the manufacturing method.

FIG. 4 is a schematic perspective view showing a recording head according to an embodiment of the present invention.

The recording head in this embodiment includes a substrate 1 of Si on which energy generating elements 7 for generating energy utilized for ejecting ink as recording liquid are formed and arranged with a predetermined pitch. The substrate 1 is provided with a supply port 8, formed by subjecting Si to anisotropic etching, which is opened between two arrays of the energy generating elements 7. On the substrate 1, ejection outlets 5 provided by a flow passage forming member 2 at positions opposite to the respective energy generating elements 7 and individual flow passages extending from the supply port 8 and communicating with associated ones of the ejection outlets 5. Incidentally, the positions of the ejection outlets 5 are not limited to those opposite to the energy generating elements 7.

In the case where the recording head is used as the ink jet recording head, a surface at which the ejection outlets 5 are formed is disposed so as to face a recording surface of a recording medium. The recording head causes energy generated by the energy generating elements 7 to act on ink filled in the flow passages through the supply port 8, thus ejecting ink droplets from the ejection outlets 5. Recording is effected by depositing these ink droplets on the recording medium. As the energy generating element, an electrothermal transducer or the like for thermal energy (so-called a heater) and a piezoelectric element or the like for mechanical energy may be used but the energy generating element is not limited to these elements.

Figure 5:
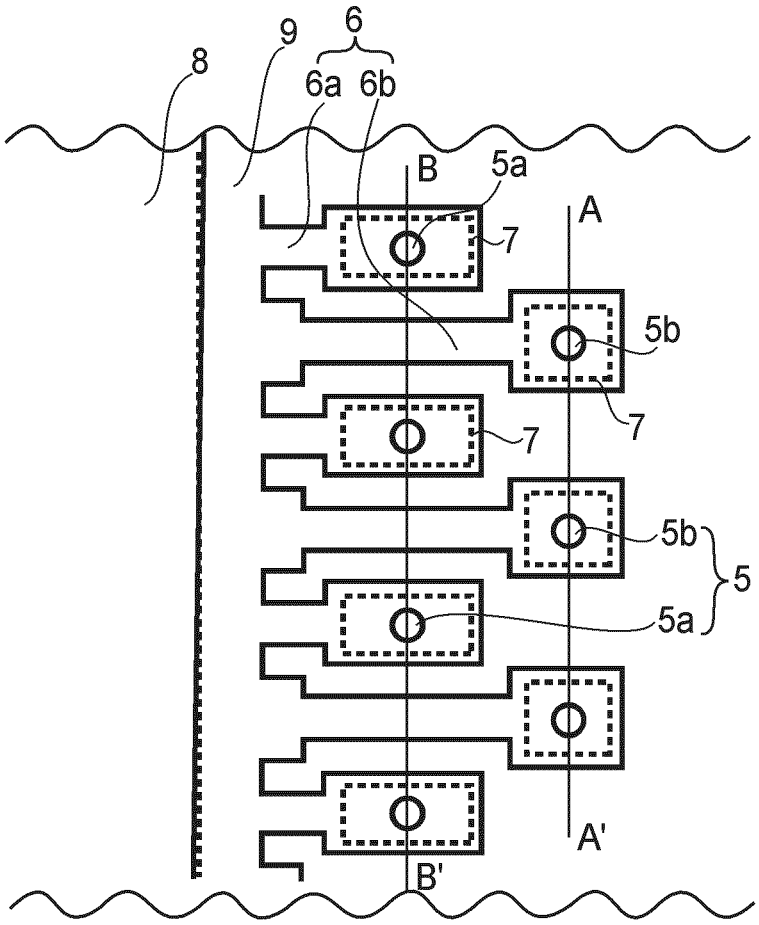
FIG. 5 is a schematic view for illustrating the embodiment of the manufacturing method.

FIG. 5 is a perspective plan view showing an embodiment of the recording head in the present invention as seen from an ejection outlet side toward a substrate surface. In this embodiment shown in FIG. 5, on one side of the supply port 8, ejection outlets 5*a* located relatively closer to the supply port 8 and ejection outlets 5*b* located relatively apart from the supply port 8 are arranged in a staggered fashion and communicate with a common liquid chamber 9 through flow passages 6*a* communicating with the ejection outlets 5*a* and flow passages 6*b* communicating with the ejection outlets 5*b*.

FIGS. 1(*a*) to 1(*f*) are schematic sectional views, for illustrating an embodiment of the manufacturing method of the recording head according to the present invention, taken along B-B' line shown in FIG. 5 and partly showing a peripheral portion of the flow passage 6*a* as the flow passage 6.

As shown in FIG. 1(*a*), a first negative photosensitive resin layer 20 is formed on the substrate 1. As the substrate 1, a substrate of glass, ceramics, metal, or the like, on which an energy generating element 7 for ejecting ink is formed is used. As the energy generating element 7, the electrothermal transducer, the piezoelectric element, or the like is used but the energy generating element 7 is not limited these elements. In the case where the electrothermal transducer is used as the energy generating element, a protecting film (not shown) is formed at a surface of the energy generating element for the purpose of impact relaxation during bubble generation, alleviation of damage from the ink, and the like.

The first negative photosensitive resin layer 20 can be formed by applying a negative photosensitive resin material onto a surface of the substrate 1. As a method of applying the negative photosensitive resin material, it is possible to use a spin coating method, a direct coating method, a lamination transfer method, and the like but the application method is not limited to these methods.

As the negative photosensitive resin material used for forming the first negative photosensitive resin layer 20, it is possible to use those utilizing cationic polymerization, radical polymerization, and the like but the negative photosensitive resin material is not limited to those resin materials. When the negative photosensitive resin material utilizing a cationic polymerization reaction is taken as an example, cations generated from a photo-cation polymerization initiator contained in the negative photosensitive resin material promote polymerization or cross-linking between molecules of cationically polymerizable monomers or polymer to cure the negative photosensitive resin material.

As the photo-cation polymerization initiator, it is possible to use aromatic iodonium salts, aromatic sulfonium salts, and the like. Specifically, e.g., photo-cation polymerization initiators ("ADEKA OPTOMER SP-170", "ADEKA OPTOMER SP-150" (trade name)) are commercially available from ADEKA CORPORATION.

As the cationically polymerizable monomer or polymer, those having an epoxy group, a vinyl ether group, or an oxetane group are suitable but the monomer or polymer is not limited to these monomers or polymers. Examples thereof may include a bisphenol A epoxy resin material, a novolac epoxy resin material, an oxetane resin material such as "ARON OXETANE" (trade name, mfd. by TOAGOSEI CO., LTD.), an aliphatic epoxy resin material such as "CELLOXIDE 2021" (trade name, mfd. by DAICEL CHEMICAL INDUSTRIES, LTD.), a monoepoxide having a linear alkyl group such as "AOE" (trade name, mfd. by DAICEL CHEMICAL INDUSTRIES, LTD.), etc. Further, a multi-functional epoxy resin material described in Japanese Patent No. 3143308 exhibits a very high cationic polymerization property and a high crosslink density after curing and thus provides a cured product excellent in strength, thus being particularly preferred. As the multifunctional epoxy resin material, e.g., "EHPE-3150" (trade name, by DAICEL CHEMICAL INDUSTRIES, LTD.) and the like may be used.

Further, in order to improve application properties such as film uniformity during film formation by application, a glycol compound may preferably be contained in the negative photosensitive resin material. For example, the glycol compound may be diethylene glycol dimethyl ether or triethylene glycol methyl ether but is not limited to these compounds.

Next, as shown in FIG. 1(*b*), the first negative photosensitive resin layer 20 is subjected to light exposure in a predetermined area and then is subjected to patterning by development to form a part of an ink flow passage wall 2*a*. In this step, a portion to be formed as the ink flow passage is light-blocked and an area other than the portion to be formed as the ink flow passage is irradiated with light to cure the negative photosensitive resin material, thus forming the ink flow passage wall. As developing liquid, it is possible to use methyl isobutyl ketone, a mixture solvent of methyl isobutyl ketone/xylene, and the like.

Next, as shown in FIG. 1(*c*), a first positive photosensitive resin layer 3 as a solid layer occupying a part of an area for constituting the flow passage is formed so as to coat the ink flow passage wall 2*a*. As a positive photosensitive resin material used for forming the first positive photosensitive resin layer 3, it is possible to use a resist, having a photosensitive wavelength region in the neighborhood of 290 nm, such as polymethyl isopropenyl ketone (PMIPK), polyvinyl ketone, or the like. It is also possible to use a resist, having a photosensitive wavelength region in the neighborhood of 250 nm, such as polymethyl methacrylate (PMMA) or the like.

As a forming method of the first positive photosensitive resin layer 3, it is possible to use the spin coating method, the direct coating method, and the lamination transfer method but the forming method is not limited to these methods.

Next, as shown in FIG. 1(*d*), the first positive photosensitive resin layer 3 is abraded until a surface of the flow passage wall 2*a* is exposed. As an abrading method, it is possible to use a CMP (chemical mechanical polish) technique, which is a chemical mechanical polishing method, by using slurry. In this case, the negative photosensitive resin material used for forming the flow passage wall 2*a* is sufficiently cross-linked by light exposure, so that the flow passage wall 2*a* sufficiently functions as a polishing (abrasion) stop layer by utilizing a difference in hardness between the flow passage wall 2*a* and the first positive photosensitive resin layer 3. As a result, it is possible to abrade the first positive photosensitive resin layer 3 so that the surface of the flow passage wall 2*a* and the surface of the first positive photosensitive resin layer 3 coincide with each other. Thus, the first positive photosensitive resin layer 3 and the flow passage wall 2*a* have the substantially same height from the substrate 1.

As another method of flattening the first positive photosensitive resin layer 3 and the flow passage wall 2*a*, it is possible to use dry etching.

Through the above-described steps, the substrate on which the flow passage wall 2*a* for forming a part of the wall of the flow passage and the first positive photosensitive resin layer 3 as the solid layer having a shape of a part of the flow passage are provided so as to contact each other is prepared. Of a portion constituting the flow passage, the portion filled with the first positive photosensitive resin layer 3 has side surfaces substantially perpendicular to the substrate 1 since the flow passage wall 2*a* is formed substantially perpendicularly to the substrate 1. Further, the first positive photosensitive resin layer 3 and the flow passage wall 2*a* have the substantially same height from the substrate 1 and can be formed in a flat surface, so that of the flow passage-forming portion, the height of the portion filled with the first positive photosensitive resin layer 3 can be ensured with accuracy. Further, it is possible to flatly laminate a pattern of another portion of the flow passage to be formed later or an ejection outlet-forming member.

Next, as shown in FIG. 1(*e*), on a common surface, obtained by the abrasion, of the flow passage wall 2*a* and the first positive photosensitive resin layer 3, a second positive photosensitive resin layer 40 is formed. The second positive photosensitive resin layer 40 can be formed by applying a photo-degradable positive resist onto the abraded surface. As the application method of the photo-degradable positive resist, it is possible to use the spin coating method, the direct coating method, the lamination coating method, and the like but the application method is not limited to these methods.

Next, as shown in FIG. 1(*f*), the second positive photosensitive resin layer 40 is subjected to light exposure in a predetermined area and then is subjected to patterning by development to form a pattern 4 having a shape of a part of the ink flow passage. As a positive photosensitive resin material used for forming the second positive photosensitive resin layer 40, it is possible to use resists similar to those described above for the positive photosensitive resin material for forming the first positive photosensitive resin layer 3.

As developing liquid for the second positive photosensitive resin layer 40, there is no particular limit in solvent so long as the solvent dissolves an exposed portion improved in solubility and does not dissolve an un-exposed portion. It is generally possible to use methyl isobutyl ketone, propylene glycol monomethyl ether acetate. Further, as developing liquid for preventing crack during the development, it is possible to suitably use glycol ether having 6 or more carbon atoms which can be mixed with water in an arbitrary ratio, a nitrogen-containing basic organic solvent, and water-containing developing liquid. For example, developing liquid having a composition disclosed in Japanese Patent Publication (JP-B) (Tokko) Hei 3-10089 as developing liquid for PMMA which is used as a resist for X-ray lithography can also be used suitably in the present invention.

The positive photosensitive resin material used for forming the second positive photosensitive resin layer 40 may be a resist which is different from or identical to that as the positive photosensitive resin material used for forming the first positive photosensitive resin layer 3.

For example, as shown in FIG. 18, in the case where the first positive photosensitive resin layer 3 is not completely coated (the first positive photosensitive resin layer 3 is partly exposed at its surface), it is desirable that the second positive photosensitive resin layer 40 is formed of a resist different from that for the first positive photosensitive resin layer 3. This is for the following reason. First, when the pattern 4 is formed by subjecting the second positive photosensitive resin layer 40 to patterning by the light exposure, light to be used for the light exposure reaches the first positive photosensitive resin layer 3. At this time, in order that the first positive photosensitive resin layer 3 is not subjected to patterning, the second positive photosensitive resin layer 40 may preferably be formed of a material different in photosensitive wavelength from that for the first positive photosensitive resin layer 3.

Figure 3:
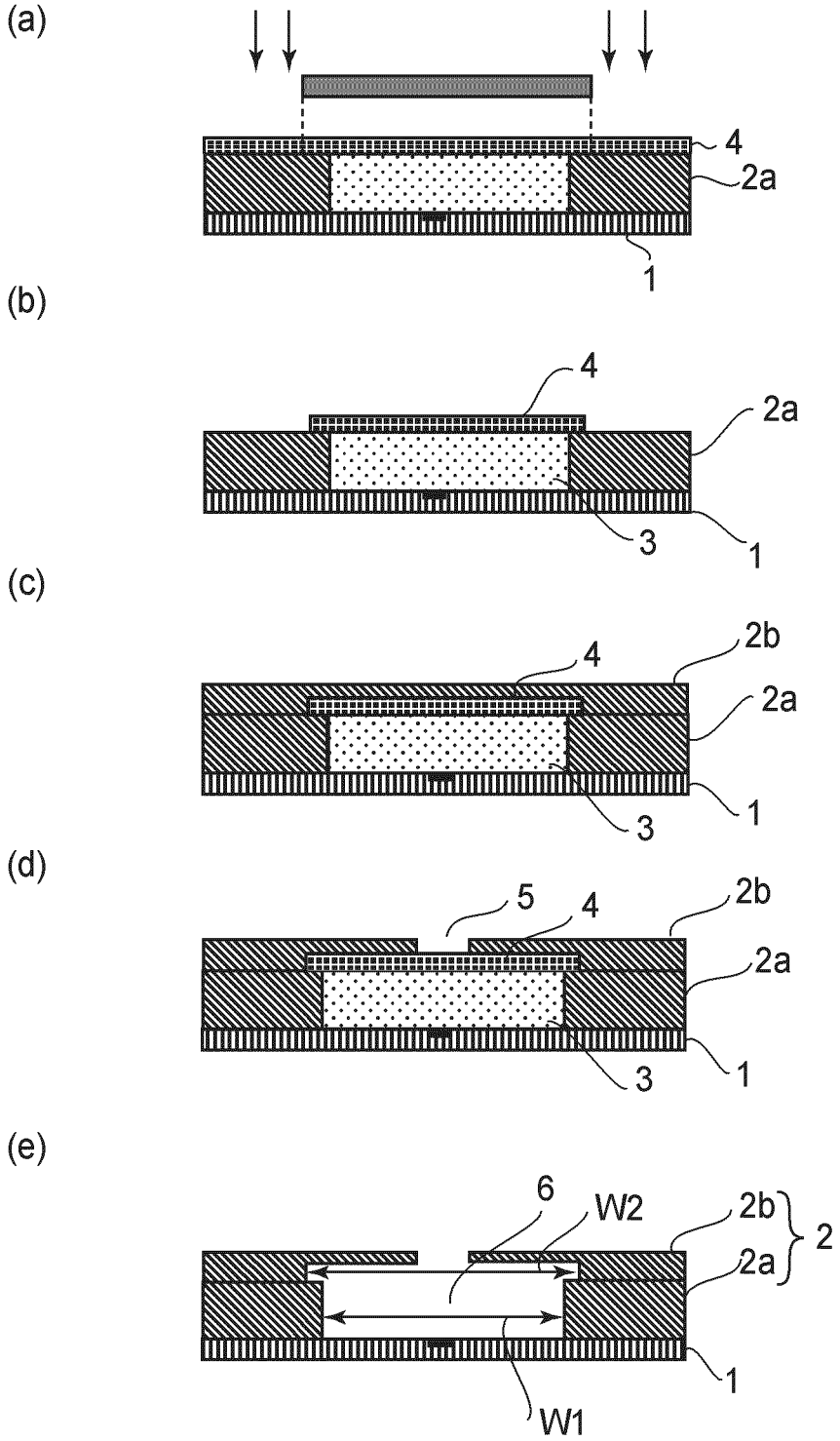
FIGS. 3(*a*) to 3(*e*) are schematic sectional views for illustrating another embodiment of the manufacturing method of a liquid ejection head according to the present invention.

On the other hand, as shown in FIG. 3(*b*), in the case where a second positive photosensitive resin layer 4 is formed so as to extend and coat a surface from the first positive photosensitive resin layer 3 to the flow passage wall 2*a*, the second positive photosensitive resin layer 4 fan be formed of the same material as that for the first positive photosensitive resin layer 3. This is for the following reason.

As shown in FIG. 3(*a*), when the second positive photosensitive resin layer 4 is exposed to light in order to form a pattern 4, only a portion, of the second positive photosensitive resin layer 4, located on the flow passage wall 2*a* is exposed to light. For this reason, light used for the light exposure of the second positive photosensitive resin layer 4 does not reach the first positive photosensitive resin layer 3. The light used for the light exposure of the second positive photosensitive resin layer 4 reaches the flow passage wall 2*a* but the flow passage wall 2*a* is formed of a cured product of the negative photosensitive resin material or metal, which has no positive photosensitivity, so that the flow passage wall 2*a* is not photodegraded by the light used for the light exposure of the second positive photosensitive resin layer 4.

Figure 2:
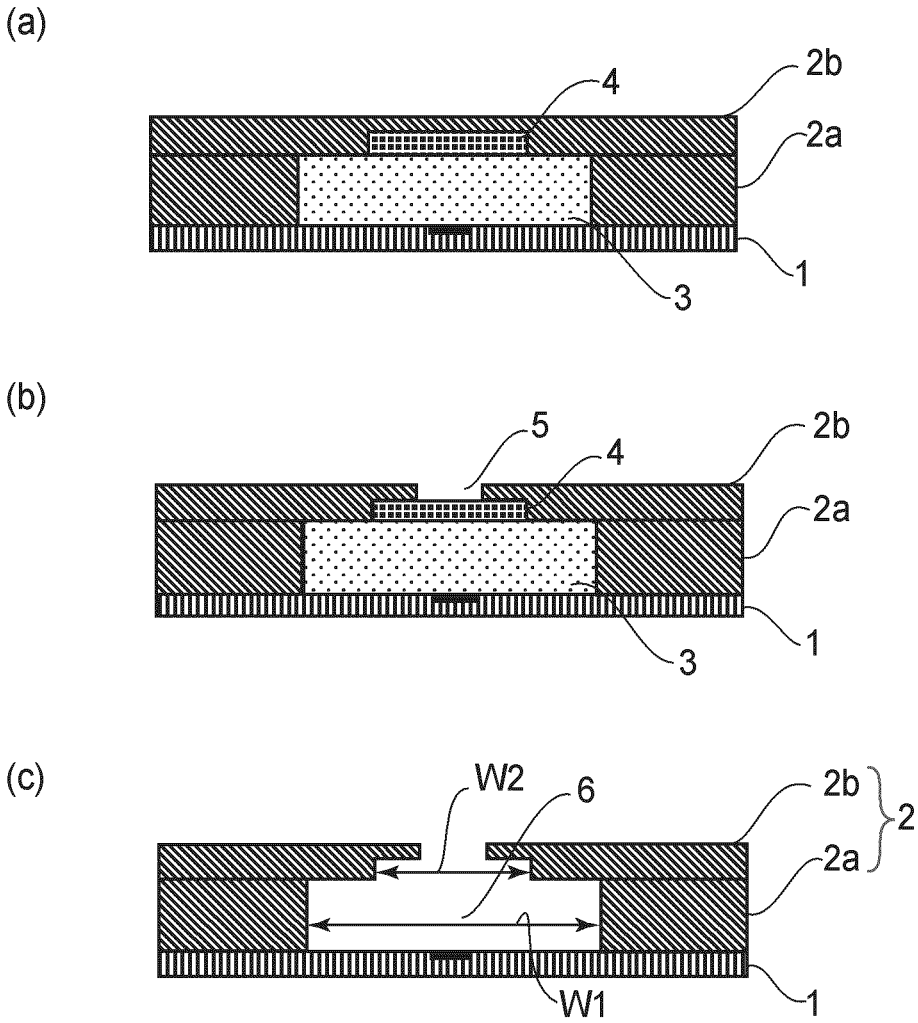
FIGS. 2(*a*) to 2(*c*) are schematic sectional views for illustrating the embodiment of the manufacturing method.

Next, as shown in FIG. 2(*a*) or 2(*c*), a second negative photosensitive resin layer 2*b* is formed so as to coat the pattern 4.

Then, as shown in FIG. 2(*b*) or 3(*d*), the second negative photosensitive resin layer 2*b* is subjected to patterning by light exposure and development to form an ejection outlet (nozzle) 5. The second negative photosensitive resin layer 2*b* can be formed by applying a negative photosensitive resin material. As the negative photosensitive resin material used for forming the second negative photosensitive resin layer 2*b*, it is possible to the same material as that for the first negative photosensitive resin layer 2*a*. The application method of the negative photosensitive resin material may be the spin coating method, the direct coating method, the lamination transfer method, and the like but is not limited to these methods. Further, as desired, an ink-repellent layer (not shown) is formed on the second negative photosensitive resin layer 2*b*. In this case, it is desirable that the ink-repellent layer has cross-linkable photosensitivity similarly as the negative photosensitive resin layer used for forming the second negative photosensitive resin layer 2*b*. It is also important that a resin material for the ink-repellent layer is not compatible with the negative photosensitive resin material. The ink-repellent layer can be formed by a method such as the spin coating method, the direct coating method, the lamination transfer method, or the like. A portion to be formed as the ink ejection outlet is light-blocked and an area other then the light-blocked portion is irradiated with light to cure the negative photosensitive resin material. At this time, in the case where the ink-repellent layer is formed, the resin material for the ink-repellent layer is also cured simultaneously. Thereafter, the development is performed to form the ink ejection outlet 5. As developing liquid for the second negative photosensitive resin layer 2*b* and the ink-repellent layer, developing liquid which is capable of completely removing the un-exposed portion without dissolving the exposed portion and does not dissolve the second positive photosensitive resin layer 4 disposed under the second negative photosensitive resin layer 2*b* is optimum one. For example, it is possible to use methyl isobutyl ketone or a mixture solvent of methyl isobutyl ketone/xylene. Incidentally, the reason why it is important that the developing liquid does not dissolve the positive photosensitive resin layer 4 is that generally, a plurality of heads is disposed on one substrate and is used as ink jet recording heads though a cutting step. In other words, that is because it is desirable that the positive resist used for forming the ink flow passage pattern is dissolved and removed after the cutting step as countermeasure to prevent contamination during the cutting step.

Thereafter, as shown in FIG. 2(*c*) or FIG. 3(*e*), the first positive photosensitive resin layer 3 and the second positive photosensitive resin layer 4 which has the shape defining the ink flow passage are removed, thus forming a bubble generation chamber and the ink flow passage which communicate with each other. In this step, ionizing radiation is emitted from above the first positive photosensitive resin layer 3 and the second positive photosensitive resin layer 4 which have structure defining the ink flow passage to cause a degradation reaction of the positive resist, thus improving solubility in removing liquid. As the ionizing radiation, it is possible to use the same ionizing radiation as that used at the time of patterning of the first positive photosensitive resin layer 3 and the second positive photosensitive resin layer 4. However, this step is performed for the purpose of removing the structure defining the ink flow passage to form the ink flow passage, so that the entire surface can be irradiated with the ionizing radiation with no mask. Thereafter, it is possible to completely remove the positive resist used for forming the ink flow passage pattern by using the same developing liquid as that used at the time of patterning of the first positive photosensitive resin layer 3 and the second positive photosensitive resin layer 4. Incidentally, in this step, there is no need to consider a patterning property, so that it is possible to use a solvent which is capable of dissolving the positive resist and does not affect the negative photosensitive resin layer and the ink-repellent layer.

As shown in FIG. 1(*f*), in the case where the first positive photosensitive resin layer 3 is partly exposed, a flow passage 6 is formed in a width W2, on the ejection outlet side, smaller than a width W1 on the substrate side as shown in FIG. 2(*c*). Further, in the case where the pattern 4 is formed so as to cover the surface from the first positive photosensitive resin layer 3 to the flow passage wall 2*a* as shown in FIG. 3(*b*), the flow passage 6 is formed in a width W2, on the ejection outlet side, larger than a width W1 on the substrate side as shown in FIG. 3(*e*).

Figure 6:
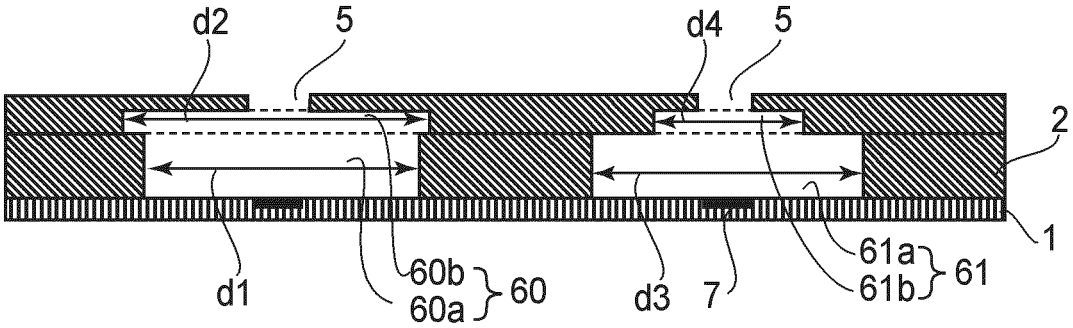
FIG. 6 is a schematic sectional view for illustrating the manufacturing method.

In the present invention, by appropriately changing the shape of the pattern 4, a flow resistance of ink in the resultant flow passage can be controlled by the shape of the pattern 4. This will be described with reference to FIG. 6. FIG. 6 is a sectional view taken along A-A' line shown in FIG. 5. FIG. 6 shows a part of the flow passage 6*b* and a part of adjacent flow passages 60 and 61. Each of substrate-side portions 60*a* and 61*a* of the flow passages 60 and 61 is a portion which was filled with the first positive photosensitive resin layer 3. In the step shown in FIG. 1(*b*), widths (a length with respect to a direction perpendicular to an arrangement direction of the energy generating elements 7 or a direction from the supply port toward the ejection outlet) d1 and d3 are substantially equal to each other. On the other hand, ejection outlet-side portions 60*b* and 61*b* of the flow passages 60 and 61 can be changed by changing the shape of the pattern 4 every flow passage. It is possible to select an area (with respect to a direction parallel to the substrate) of the pattern 4 correspondingly to a desired flow resistance value. For example, in FIG. 6, at the ejection outlet-side portions 60*b* and 61*b* of the flow passages 60 and 61, widths d2 and d4 (defined similarly as in the case of the widths d1 and d3 described above) are different from each other.

Further, with respect to the flow passage 6*b* located apart from the supply port in FIG. 5, by forming the pattern 4 so as to extend and cover the surface from the first positive photosensitive resin layer 3 to the flow passage wall 2*a* as shown in FIG. 3(*b*), it is effective that the flow passage having a such a shape that the ejection outlet-side width W2 is larger than the substrate-side width W1 is formed. This is because the portion located apart from the supply port is liable to have an insufficient flow resistance, thus attaining a larger effect of supplementing the insufficient flow resistance. On the other hand, with respect to the flow passage located close to the supply port, the flow passage has such a shape that the ejection outlet-side width W2 is smaller than the substrate-side width W1, so that it is possible to ensure an area corresponding to an area in which the ejection outlet-side width W2 of the flow passage located apart from the supply port is increased.

Incidentally, in advance to the above-described flow passage-forming step, it is possible to form the ink supply port (not shown) which penetrates through the substrate 1. As a method of forming the ink supply port, anisotropic etching or dry etching is generally used but the method is not limited to these etching methods. As an example thereof, an anisotropic etching method using a silicon substrate having a particular crystal orientation will be described. First, at a back surface of the silicon substrate 1, an etching mask is formed in an entire area while leaving only a slit portion having a size of the ink supply port. Then, the substrate 1 is dipped into an alkaline etching liquid consisting of an aqueous solution of potassium hydroxide, sodium hydroxide, tetramethylammonium hydroxide, or the like while being warmed. As a result, a portion exposed at the slit portion of the substrate 1 can be dissolved with anisotropy, so that the ink supply port can be formed. Next, the etching mask is removed as desired. Incidentally, in this case, for the purpose of protecting the negative photosensitive resin layer and the ink-repellent layer at the surface of the silicon substrate 1 from the etching liquid, a layer of resin material or the like having resistance to the etching liquid may be formed on the surface of the silicon substrate 1 as a protection layer.

Through the above-described steps, a recording head can be prepared.

Hereinafter, several specific embodiments of the present invention will be described.

Embodiment 1

First, a silicon substrate 1 on which energy generating elements 7, a driver, and a logic circuit were formed was prepared. On the substrate 1, a first negative photosensitive resin layer 20 was formed.

As a negative photosensitive resin material for forming the first negative photosensitive resin material 20, a resist solution having the following composition was used.

| | |
|---|---|
| EHPE-3150 (trade name, mfd. by DAICEL CHEMICAL INDUSTRIES, LTD.) | 100 wt. parts |
| HFAB (trade name, by Central Glass Co., Ltd.) | 20 wt. parts |
| A-187 (trade name, mfd. by Nippon Unicar Co., Ltd.) | 5 wt. parts |
| SP170 (trade name, mfd. by ADEKA CORPORATION) | 2 wt. parts |
| Xylene | 80 wt. parts |

Onto the silicon substrate 1, the above resist solution was applied by spin coating and then was pre-baked on a hot plate at 90° C. for 3 minutes, thus forming a 14 μm-thick first negative photosensitive resin layer 20 in a flat plate-like shape (FIG. 1(*a*)).

Next, the first negative photosensitive resin layer 20 was subjected to pattern exposure at an exposure amount of 200 mJ/cm$^2$ through a mask provided with a pattern of an ink flow passage wall by using a mask aligner ("MPA 600FA" (trade name)), mfd. by Canon Kabushiki Kaisha). Then, the first negative photosensitive resin layer 20 was subjected to PEB (post exposure bake) at 90° C. for 180 sec, development using a mixture solution of methyl isobutyl ketone/xylene=2/3, and rising with xylene to form a structure 2*a* to be formed as an ink flow passage wall (FIG. 1(*b*)).

Next, the structure 2*a* was coated with a first positive photosensitive resin layer 3. As a photodegradable positive resist for forming the first positive photosensitive resin layer 3, polymethyl isopropenyl ketone (trade name; "ODUR-1010", mfd. by TOKYO OHKA KOGYO CO., LTD.) was used. Specifically, the positive resist was adjusted to provide a resin material concentration of 20 wt. % and was applied onto the first negative photosensitive resin layer 20 by spin coating. Thereafter, the positive resist was subjected to pre-baking on a hot plate at 120° C. for 3 minutes and then pre-baking in a nitrogen-aerated oven at 150° C. for 30 minutes to form a 10 μm-thick first positive photosensitive resin layer 3 (FIG. 1(*c*)).

Next, the first positive photosensitive resin layer 3 was abraded until a surface of the structure 2*a* to be formed as the ink flow passage wall was exposed by using a CMP machine ("ARW-681MS", trade name, mfd. by MAT Inc.) (FIG. 1(*d*)).

Next, on the resultant abraded surface, a second positive photosensitive resin layer 40 was formed. As a photodegradable positive resist for forming the second positive photosensitive resin layer 40, a copolymer of methyl methacrylate (MMA)/methacrylic acid (MAA)=90/10 (weight ratio) (weight–average molecular weight=100,000 as the molecular weight of polystyrene) was used. Specifically, a resist solution of the copolymer in diethyl glycol dimethyl ether in a solid content concentration of 20 wt. % was applied onto the abraded surface by spin coating. Thereafter, the applied resist solution was subjected to pre-baking on a hot plate at 100° C. for 3 minutes and then pre-baking in a nitrogen-aerated oven at 150° C. for 30 minutes to form a 5 μm-thick second positive photosensitive resin layer 40 (FIG. 1(*e*)).

Next, the surface of the second positive photosensitive resin layer 40 was irradiated with deep-UV light at an exposure amount of 50,000 mJ/cm$^2$ through a mask provided with a flow passage pattern for small dots by using a deep-UV exposure device (trade name: "UX-3000", mfd. by USHIO INC.). Thereafter, the second positive photosensitive resin layer 40 was developed with a mixture solution having the following composition.

| | |
|---|---|
| Diethylene glycol monobutyl ether | 60 vol. % |
| Monothanolamine | 5 vol. % |
| Morpholine | 20 vol. % |
| Ion exchange water | 15 vol. % |

Subsequently, the second positive photosensitive resin layer 40 was subjected to rinsing with isopropyl alcohol to form a pattern 4 for forming an ink flow passage (FIG. 1(*f*)).

Next, an about 10 μm-thick second negative photosensitive resin layer 2*b* was formed so as to coat the pattern 4 (the second positive photosensitive resin layer 40) having a structure defining the ink flow passage by using the same resist as the negative photosensitive resin material used for forming the first negative photosensitive resin layer 2 (FIG. 2(*a*)).

Next, on the second negative photosensitive resin layer 2*b*, an ink-repellent layer (not shown) was formed of a photosensitive resin material having the following composition by a lamination method.

| | |
|---|---|
| EHPE-3150 (trade name, mfd. by DAICEL CHEMICAL INDUSTRIES, LTD.) | 35 wt. parts |
| 2,2-bis(4-glycidyloxyphenyl)hexafluoropropane | 25 wt. parts |
| 3-(2-perfluorohexyl)ethyl-1,2-epoxypropane | 16 wt. parts |
| A-187 (trade name, mfd. by Nippon Unicar Co., Ltd.) | 4 wt. parts |
| SP170 (trade name, mfd. by ADEKA CORPORATION) | 1.5 wt. parts |
| Diethyl glycol monoethyl ether | 200 wt. parts |

Next, the second negative photosensitive resin layer 2*b* was subjected to pattern exposed at an exposure amount of 300 mJ/cm$^2$ through a mask provided with a pattern of an ink ejection outlet by using a mask aligner ("MPA 600FA" (trade name)), mfd. by Canon Kabushiki Kaisha). Then, the first negative photosensitive resin layer 20 was subjected to PEB (post etching bake) at 90° C. for 180 sec, development using a mixture solution of methyl isobutyl ketone/xylene=2/3, and rising with xylene to form an ejection outlet 5 in the second negative photosensitive resin layer 2*b* (FIG. 2(*b*)).

Next, the first and second positive photosensitive resin layers for forming the ink flow passage was solubilized and thereafter was dipped into methyl lactate while applying ultrasonic wave, thus removing the positive resists for forming the ink flow passage (FIG. 2(*c*)).

An ink jet head manufactured by the above-described method had such a shape that the ink flow passage wall was formed in a vertical direction. When the ink jet head was mounted in a printer and was subjected to ejection and recording evaluation, the ink jet head was capable of performing stable printing and provided a high-quality print.

Embodiment 2

An ink jet head was prepared in the same manner as in Embodiment 1 except that the following changes were made.

The second positive photosensitive resin layer 40 and the first positive photosensitive resin layer 3 were formed of the same positive photosensitive resin material.

The pattern 4, for forming the ink flow passage, formed by patterning of the second positive photosensitive resin layer 40 had such a shape that the pattern covered the surface from the first positive photosensitive resin layer 3 to the flow passage wall 2*a* (FIG. 3(*b*)).

An ink jet head manufactured by the above-described method had such a shape that the ink flow passage wall was formed in a vertical direction. When the ink jet head was mounted in a printer and was subjected to ejection and recording evaluation, the ink jet head was capable of performing stable printing and provided a high-quality print.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 294267/2007 filed Nov. 13, 2007, which is hereby incorporated by reference.

What is claimed is:

1. A manufacturing method of a liquid ejection head provided with a flow passage communicating with an ejection outlet for ejecting liquid, said manufacturing method comprising:

preparing a substrate on which a flow passage wall forming member for forming a part of a wall of the flow passage and a solid layer having a shape of a part of the flow passage contact each other, wherein the substrate has an energy generating element and the solid layer includes a region covering the energy generating element and a region covering the flow passage wall forming member;

abrading the solid layer in a direction toward the substrate to form a flattened surface of the solid layer;

providing, on the flattened surface of the solid layer, a layer forming a pattern having a shape of another part of the flow passage;

providing a coating layer, for forming another part of the wall of the flow passage, so as to coat the layer forming the pattern;

providing the ejection outlet in the coating layer; and forming the part of the flow passage by removing the solid layer, and forming the another part of the flow passage by removing the layer of the pattern in its entirety.

2. The method according to claim 1, wherein the pattern extends from the flattened surface of the solid layer to a surface of the flow passage wall forming member.

3. The method according to claim 1, wherein the pattern and the solid layer are formed of different positive photosensitive resin materials.

4. The method according to claim 1, wherein the pattern and the solid layer are formed of the same positive photosensitive resin material.

5. The method according to claim 1, wherein the liquid ejection head is provided with a plurality of flow passages, wherein the solid layer corresponds to a first flow passage and another solid layer corresponds to a second flow passage, with the solid layer and the another solid layer having substantially equal widths, and wherein the pattern corresponds to the first flow passage and another pattern corresponds to the second flow passage, with the pattern and the another pattern having different widths with respect to a direction parallel to a surface of the substrate.

6. The method according to claim 1, wherein the substrate is prepared by:

providing the flow passage wall forming member on the substrate; and providing the solid layer on the substrate so as to coat the flow passage wall forming member.

7. The method according to claim 1, wherein the solid layer is abraded by a chemical mechanical polish technique.

8. The method according to claim 1, wherein the coating layer coats the pattern so as to cover an upper surface and side surfaces of the pattern.

9. A manufacturing method of a liquid ejection head provided with a flow passage communicating with an ejection outlet for ejecting liquid, said manufacturing method comprising:

preparing a substrate on which a solid layer is provided;

abrading the solid layer in a direction toward the substrate to form a flattened surface of the solid layer so that the solid layer has a shape of a part of the flow passage;

providing, on the flattened surface of the solid layer, a layer forming a pattern having a shape of another part of the flow passage;

providing a coating layer, for forming a wall of the flow passage, so as to coat the layer forming the pattern;

forming the ejection outlet in the coating layer; and forming the part of the flow passage by removing the solid layer, and forming the another part of the flow passage by removing the layer of the pattern in its entirety.

10. The method according to claim 9, wherein the pattern and the solid layer are formed of different positive photosensitive resin materials.

11. The method according to claim 9, wherein the pattern and the solid layer are formed of the same positive photosensitive resin material.

12. The method according to claim 9, wherein the liquid ejection head is provided with a plurality of flow passages, wherein the solid layer corresponds to a first flow passage and another solid layer corresponds to a second flow passage, with the solid layer and the another solid layer having substantially equal widths, and wherein the pattern corresponds to the first flow passage and another pattern corresponds to the second flow passage, with the pattern and the another pattern having different widths with respect to a direction parallel to a surface of the substrate.

13. The method according to claim 9, wherein the solid layer is abraded by a chemical mechanical polish technique.

14. The method according to claim 9, wherein the coating layer coats the pattern so as to cover an upper surface and side surfaces of the pattern.

15. The method according to claim 9, wherein a width of the solid layer is wider than a width of the layer forming the pattern having the shape of the another part of the flow passage with respect to a direction parallel to a surface of the substrate.

16. A manufacturing method of a liquid ejection head provided with a flow passage communicating with an ejection outlet for ejecting liquid, said manufacturing method comprising:

preparing a substrate on which a solid layer is provided;

abrading the solid layer in a direction toward the substrate by a chemical mechanical polish technique to form an abraded surface of the solid layer, so that they solid layer has a shape of a part of the flow passage;

providing, on the abraded surface of the solid layer, a layer forming a pattern having a shape of another part of the flow passage;

providing a coating layer, for forming a wall of the flow passage, so as to coat the layer forming the pattern;

forming the ejection outlet in the coating layer; and forming the part of the flow passage by removing the solid layer, and forming the another part of the flow passage by removing the layer of the pattern in its entirety.

17. The method according to claim 16, wherein a width of the solid layer is wider than a width of the layer forming the pattern having the shape of the another part of the flow passage with respect to a direction parallel to a surface of the substrate.

* * * * *